United States Patent [19]

Ruiz et al.

[11] Patent Number: 4,590,717

[45] Date of Patent: May 27, 1986

[54] STATIC THREE HINGED ARCH BUILDING STRUCTURE

[76] Inventors: Antonio R. Ruiz, c/o 919 W. Berkeley, Santa Ana, Calif. 92707; William M. Simpson, 2340 Bayside Dr., Corona Del Mar, Calif. 92625

[21] Appl. No.: 489,371

[22] Filed: Apr. 28, 1983

[51] Int. Cl.[4] ..... E04B 1/344

[52] U.S. Cl. ..... 52/64; 52/79.11; 52/91; 52/741

[58] Field of Search ..... 52/64, 71, 86, 79.1, 52/79.5, 79.9, 79.11, 90, 91, 93, 745, 747, 741

[56] References Cited

U.S. PATENT DOCUMENTS

| | | | |
|---|---|---|---|
| 2,611,454 | 9/1952 | Arehart et al. | 52/93 X |
| 2,881,878 | 4/1959 | Erickson | 52/93 X |
| 3,849,953 | 11/1974 | Cohen | 52/86 |
| 3,898,776 | 8/1975 | Cox et al. | 52/91 X |
| 4,187,651 | 2/1980 | Tolsma | 52/93 X |
| 4,241,551 | 12/1980 | Lajoie et al. | 52/90 |

*Primary Examiner*—J. Karl Bell

*Attorney, Agent, or Firm*—Ben E. Lofstedt

[57] ABSTRACT

A structural building module has first and second upright cast structural members. Each of the first and second structural upright members include a wall portion and a roof portion. These structural members are initially supported on erection pads such that the wall portions are upright and the roof portions project toward one another such that the roof portions can be joined together. After joining the roof portions a structural base is formed in situ by casting. The structural base is attached to the wall portions of the structural members by entraining into the structural base, attaching members projecting out of the wall portions near their bottom edge.

16 Claims, 12 Drawing Figures

20
22
24
26
28
32
34
35
36
2
2

72
78
72
30b
26
24
30a
74
74
40
40
30c
38a
38c
106
110
106
106
3
3
94
88
100
98
102
96
96
88a
88c
102
90
90

26
100
92
98
94
102
102
90

STATIC THREE HINGED ARCH BUILDING STRUCTURE

BACKGROUND OF INVENTION

This invention is directed to a modular building structure wherein a first and second structural member each having a wall and roof portion are pivotally joined about the roof portions and operatively connected by an in situ cast base structural means spanning between the bottoms of the wall portion.

With increases in the cost of both construction labor and construction materials the cost of housing has escalated to such an extent that for conventional construction methods the purchase of a residential structure is beyond the economic reach of the majority of the population. In order to provide low cost housing it is evident that it has become necessary to abandon conventional construction techniques and seek other techniques which are more cost effective.

Certain factory manufactured housing has recently been introduced. Generaly this housing utilizes construction techniques which are carried over from mobile homes and the like. This includes the use of shells and the like which are essentially mounted on a chasis such that they can be towed to a permanent site wherein the finished building will be located. The construction of the walls and roofs of these buildings while of lower costs then on-site framing or other on-site techniques still are labor intensive. While the cost of this type of housing is lower than custom on-site construction the labor utilized in constructing this type of housing does limit the ultimate economic savings possible and as such the ultimate consumer price.

It has been suggested to utilize pre-cast concrete segments to construct modular base buildings. For the most part the previously known modular based concrete panel constructions deviated extensively from designs based on more traditional constructions and values. Insofar as the designs of these modular buildings deviated extensively from standard existing construction styles for residence, the acceptance of the same has been limited.

In certain existing modular construction proposals a variety of individual units must be utilized in the erection of a building. Because each of the individual units must be cast in its own individual form, this entails the construction of a multiplicity of forms corresponding to each of the individual units. Such a multiplicity of forms of course directly influences the ultimate cost of the units resulting in higher consumer prices.

BRIEF DESCRIPTION OF THE INVENTION

In view of the above it is evident that there exists a need for new construction ideas and techniques which will result in the production of lower cost housing. Further it is evident that these construction ideas and techniques must not be extremely radical from a design point of view in order that the ultimate structures incorporating these ideas and techniques are acceptable to the buying public. In view of this, it is therefore an object of this invention to provide a new construction building module and a process for preparing the same which is susceptible to mass production methods yet incorporates sufficient versatility to allow for application of the same to a variety of individual designs. It is a further object of this invention to prepare structural building modules which by their engineering principals incorporated therein are extremely resistant to cataclysmic events of nature such as earthquakes, high winds and the like. It is a further object of this invention because of the principals incorporated therein to provide structural building modules which can be factory prepared or prepared on the site using readily portable molds and the like followed by rapid on-site erection of the modules to facilitate rapid construction of the buildings incorporating the modules. Furthermore, it is an object of this invention to provide a standardized construction method which can be reviewed once by the appropriate building code authorities and receive approval thereof for multiple use thus eliminating wasteful use of costly governmental resources necessary for individually reviewing each individual building and the like.

These and other objects as will be evident from the remainder of this specification are achieved in a structural building module which comprises: a first integrally cast upright structural member having a first wall portion and a first roof portion, said first wall portion having a support edge, said first roof portion having a joining edge; a second integrally cast upright structural member having a second wall portion and a second roof portion, said second wall portion having a support edge, said second roof portion having a joining edge; a first structural member support means and a second structural member support means, said first and said second support means locatable in the supporting medium on which said structural building module will rest, each of said first and second support means having a portion thereof located near the surface level of said medium, each of said support means for supporting one of said structural members in an upright position on said portion of said support means located near surface level by contact of said structural member support edges on said portion of said support means located near surface level; joining means for joining together said joining edges on said first and said second roof portions when said joining edges are located adjacent to each other; said first and said second support means spaced apart from each other in said support medium a distance essentially corresponding to the finished width of said structural building module whereby when said first and second upright structural members are located upright on and supported by said first and second support means said first and said second roof portions extend towards each other from said respective first and second wall portions to located said joining edges adjacent to each other in a position joinable by said joining means and together said first and second roof portions form the roof of said structural module; an in situ formed structural base means, said structural base means formed by casting in situ after said first and said second upright structural members are located on and supported by said first and second support means, as formed said structural base means operatively connecting to said support edges both on said first and said second upright structural members and extending essentially horizontally between said support edges of said first and said second upright structural members; said structural base means operatively connecting to said support edges and said joining means joining said joining edges serving to hold said first and said second structural members connected to one another in an upright position with said first and said second wall portions being essentially vertical and said first and said second roof portions forming said roof between said respective wall portion.

Preferredly the joining means can pivotally join the first and second joining edges together. In the illustrative embodiment the joining means would comprise a piano type hinge extending along the totality of both joining edges to allow for convenient and rapid joining of the same.

Preferredly the structural base means would form at least a portion of the floor of the module with it being possible for the totality of the floor of the module to serve as a portion of the structural base means. Additionally, a footing means can be incorporated into the structural base means with the footing means being concurrently cast in situ with the structural base means. The footing means would be located along that portion of the structural module which directly underlies the wall portions of the first and second structural members.

An attaching means can be utilized to join the structural base means to each of the first and second structural members. The attaching means allows for on site joining of each of the first and second structural members to the structural base means. As illustrative thereof, the attaching means can include connecting members in each of the wall portions of the first and second structural members with the connecting members being located proximal to the support edges of the structural members. The connecting members would first be joined to the structural support members at one of their ends with the other of their ends then entrained into the structural base means during in situ casting of the same.

Preferredly during casting of the footing means the support means would additionally be entrained into the footing means. For convenience in doing the same the support means can include a first and second foundation member for each of the structural members with the first and second foundation members spaced apart from one another along the length of the support edge of the structural member.

Preferredly an aggregate would be utilized for both the first and second structural members and the structural base means. Preferredly for the first and second structural members this aggregate would be a gas entrained aggregate. As illustrated herein, a portland cement based air entrained aggregate is utilized for formation of the first and second structural members. This material would be both light in weight yet sufficiently strong to meet all requirements for construction. Additionally, built in insulative properties are achieved by the use of such a gas entrained portland cement based aggregate.

Further the objects of this invention are achieved in a process of constructing a modular building which comprises: casting a first and a second structural member from a gas entrained aggregate, said first and said second structural members each having a wall portion and a roof portion, each of said roof portions having a joining edge, each of said wall portions having a support edge, said joining edge and said support edge on each of said respective first and said second structural members located distal to each other on said respective first and said second structural members; locating a portion of a joining means on said joining edge on said first structural member and locating a further portion of said joining means on said joining edge on said second structural member; locating a first support means in the supporting medium on which said modular building will rest and locating a second support means in said supporting medium at a distance spaced apart from said first support means equal to essentially the width of said modular building, said first and said second support means each located in said supporting medium so as to position a portion of each of said support means near the surface level of said supporting medium; locating said first structural member on said first support means and said second structural member on said second support means such that each of said first and said second wall portions are essentially vertical and said joining edges on each of said first and said second structural members are located adjacent to one another; joining said first and said second portions of said joining means to pivotally connect said first and said second structural members together about their respective joining edges; casting a structural base means between said support edge on said first structural member and said support edge on said second structural member so as to operatively connect said support edges on both said first and said second structural member to said structural base.

BRIEF DESCRIPTION OF THE DRAWINGS

The invention described in this specification will be better understood when taken in conjunction with the drawings herein wherein.

Figure 1:
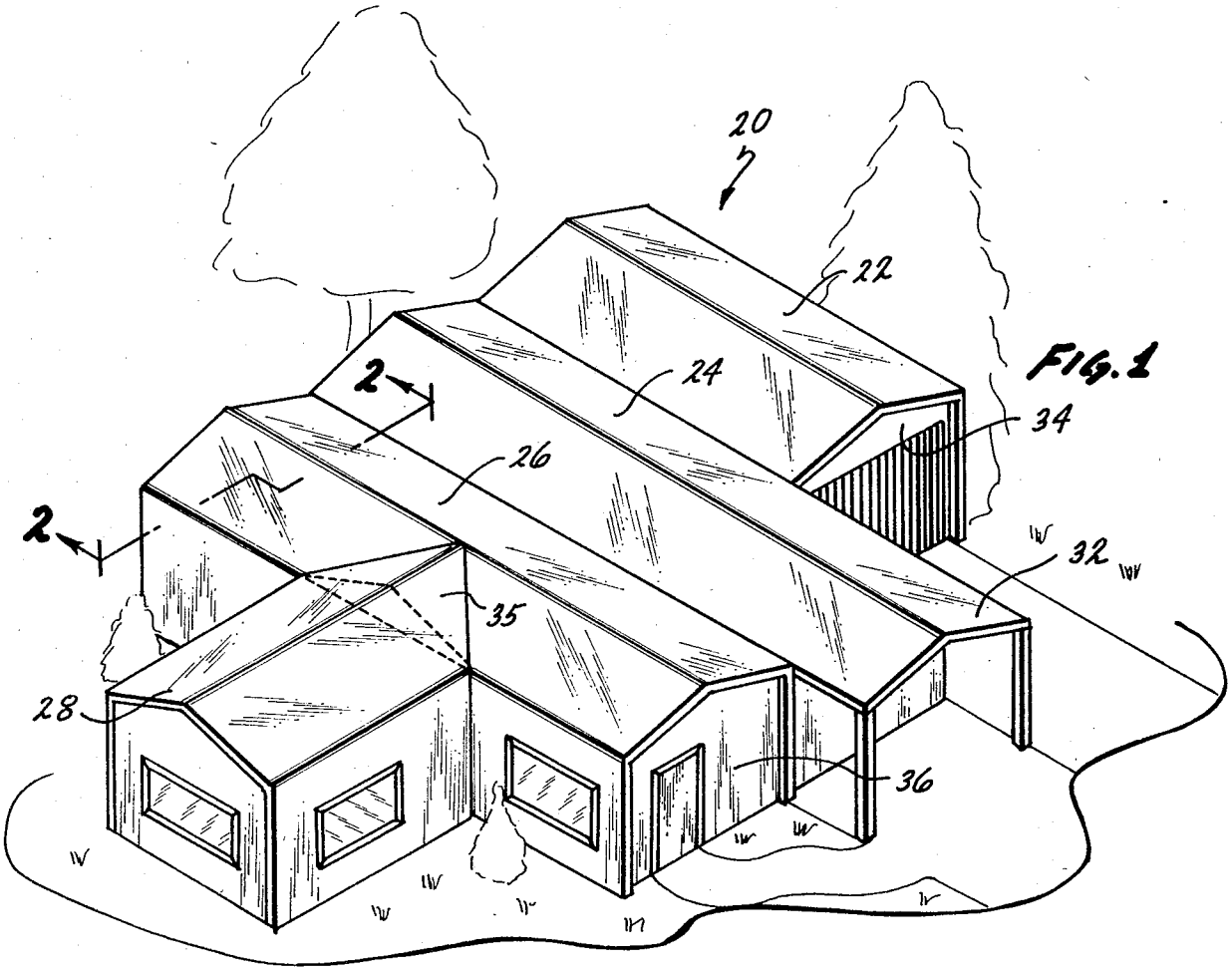
FIG. 1 is an isometrical view of a typical construction utilizing the structural building modules of this invention.

The invention described in this specification and shown in the drawings utilizes certain principals and/or concepts as are set forth in the claims appended to this specification. Those skilled in the construction arts will realize that these principals and/or concepts are capable of being illustrated in a variety of embodiments differing from the illustrative embodiments utilized herein. For this reason this invention is to be construed as being limited only by the claims and is not to be construed as to being limited to the illustrative embodiments.

DETAILED DESCRIPTION OF THE INVENTION

Referring now to the Figures, in FIG. 1 a residential structure 20 is illustrated. The structure 20 is shown with four component parts. On the immediate right is garage component 22, next to it a first living component 24, next to it a second living component 26 and projecting at a perpendicular angle to component 26 is the third living component component 28.

Figure 7:
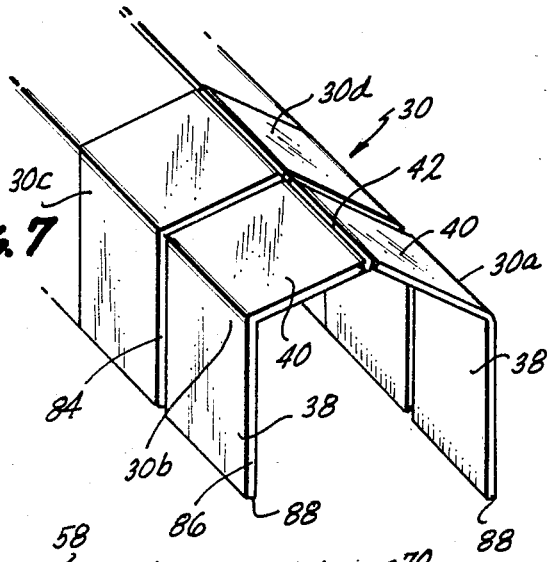
FIG. 7 is an oblique view showing a first design embodiment of the invention.

Quickly referring to FIG. 7 which shows the same cross sectional designs as components 22, 24, 26 and 28 are composed of, it can be seen that for each of the components 24, 26 and 28 a plurality of individual modular units 30 are utilized. The modular units 30 are arranged one on the left and one on the right side and then connected along the roof ridge line and other bottom walls and as is herein after described. For ease of transportation typically each of the modular units 30 would be chosen to be of an appropriate width such as 8 feet such that a plurality of the modular units 30 could be lined up one after the other to form each of the components 22, 24, 26 or 28 as seen in FIG. 1. The choice of how many individual modular units such as modular unit 30 which could be utilized to form any of the components such as components 22, 24, 26 or 28 would depend entirely on the desired square footage of space desired. Additionally the inclusion of the components such as components 22, 24, 26, 28 and 30 would also be dependent upon the floor space considerations. Alternately modular units of a width equal to the longitudinal length of the finished building could be utilized.

It is conceivable that one elongated building made up of a number of modular units 30 could be erected or alternated as seen in FIG. 1 several shorter sections of modular units 30 could be arranged side by side to yield a more suitable floor plan for a residential unit. The exact number of modular units 30 utilized and their arrangement into components such as components 22, 24, 26 and 28 would be ultimately governed by the end use of the building which was being constructed. It is obvious that a variety of different designs can be incorporated by both longitudinally and cross wise arranging a plurality of modular units such as modular units 30.

Referring back now to FIG. 1, it is evident that in utilizing the modular units 30 a complex structure such as the residential structure 20 can be created. Using the modular units 30 a structure can be created to incorporate a garage, such as the garage 22, it can be modified to include over-hanging roof areas such as over-hanging roof area 32 and the individual components can be arranged at right angles to one another such as is component 28 with respect to component 26.

Aside from the construction details given below conventional construction can also be incorporated into the modular units 30. As for instance the roof area 35 set aside by dotted lines on the roof of the living component 28 could be constructed of conventional construction materials and techniques in order to join the third living component 30 to the second living component 26.

End walls such as end wall 34 on garage component 22 or end wall 36 can also be constructed utilizing standard construction techniques such that they appropriately fit into and are tied to the modular units such as the modular unit 30. In any event it is obvious that by utilizing the principals and concepts of this invention a variety of different structures can be achieved.

Referring back again now to FIG. 7, it can be seen that each of the modular units 30 includes a wall portion 38 and a roof portion 40. These two units are integrally formed as one monolithic unit to form the modular unit 30. Two of the modular units 30 are mated together such that the wall portions 38 are placed vertically upright with the roof portions 40 extending toward each other and meeting along the ridge line 42. At the ridge line a novel method of attaching the two modular units 30 is utilized as is described in detail below. In any event the two roof portions 40 are appropriately tied together at the ridge line 42.

In order to prevent outward thrust tending to move the bottom edges of the wall portions 38 away from each other, a base portion as hereinafter described, is utilized which ties to each of the wall portions 38 preventing lateral movement of the bottom of the wall portions 38 with respect to one another.

Figure 8:
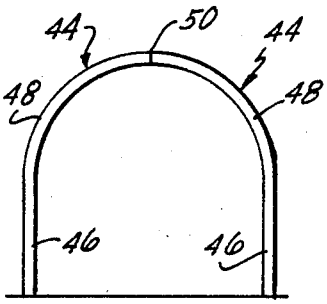
FIG. 8 is an end elevational view showing a second embodiment of the invention.
Figure 9:
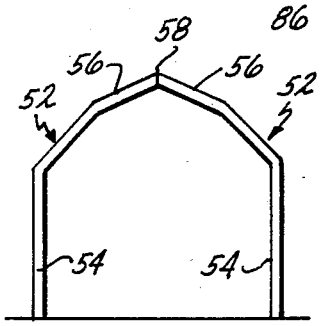
FIG. 9 is an end elevational view showing a third embodiment of the invention.
Figure 10:
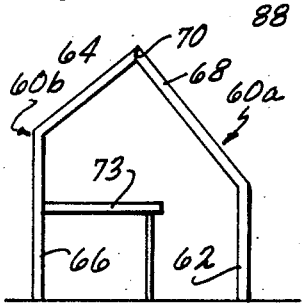
FIG. 10 is an end elevational view showing a fourth embodiment of the invention.
Figure 11:
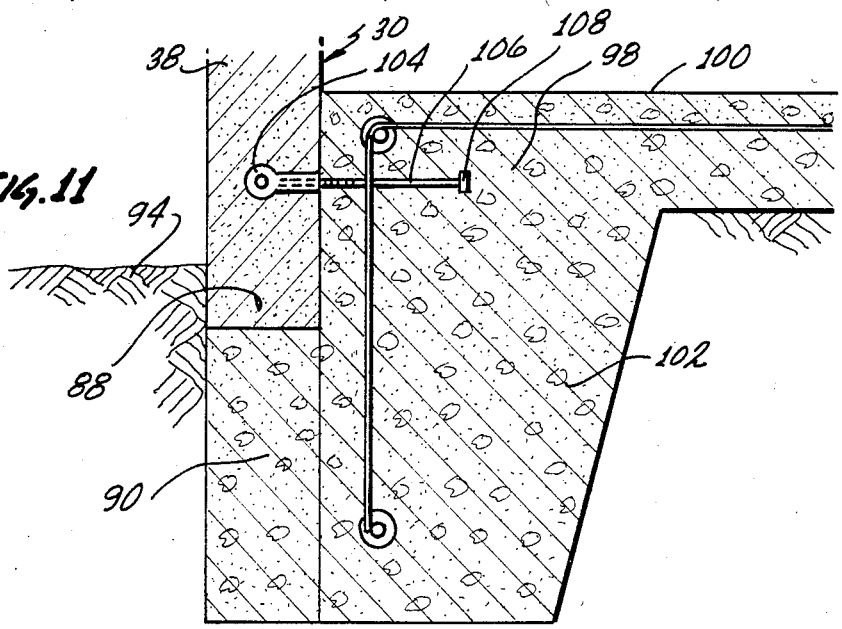
FIG. 11 is a side elevational view in partial section showing construction details of certain of the components of the invention.

Alternately to the particular design of the modular unit 30 shown in FIG. 7 other design could be utilized as is illustrated in FIGS. 8, 9 and 10. In FIG. 8 two modular units 44 are utilized. Each of the modular units 44 include a wall portion 46. Further a roof portion 48 is formed integrally with each of the wall portions 46. The roof portion 48 of the modular units 44 differ from the roof portions 40 of the modular units 30 in that they are curved or arched. In any event they are formed as a monolithic structure with the wall portions 46 with the units 44 joined together at an appropriate ridge line 50.

Moving now to FIG. 9 a further design is shown wherein two modular units 52 are utilized. Each of the modular units 52 contain a wall portion 54 with the roof portions 56 of the modular units 52 being stepped such that a gambrel roof is achieved. As before the individual roof portions 56 of the gambrel roof meet at a ridge line 58 and are joined together at this ridge line 58.

Referring now to FIG. 10 a sight modification from the prior structures of FIGS. 7, 8 and 9 are shown. In FIG. 10 two identical modular units **60*a* and 60*b* are utilized. One of the units 60*b*, however, is inverted with respect to the other unit 60*a*. As such, the portion which forms the right wall 62 of the unit 60*a* corresponds to the portion which forms the left roof 64 of unit 60*b*. The portion which forms the left wall 66 of the modular unit 60*b* corresponds to the portion which forms the right roof 68 of unit 60*a*. The components 64 and 68 are joined at a ridge line 70 with the walls 66 and 62 appropriately attached to a base structure as hereinafter described. The construction utilized in FIG. 10 would be extremely suitable for forming two story structures such that a loft 73 could be formed within the structure. The area of the structure adjacent to the wall 62 would have a cathedral like ceiling thus achieving a very open and spacy interior within the structure as shown in FIG. 10**.

It is very evident from reviewing FIGS. 7, 8, 9 and 10 that a lot of different design considerations can also be given depending upon the particular shape of the individual modules utilized and their size. A building constructed out of the modules 44 would be quite different in appearance from a building constructed out of the modules 30. This is also true with regard to the modules 52. Furthermore, by inverting one of the modules 60 with respect to the other an even different appearance is achieved.

Figure 2:
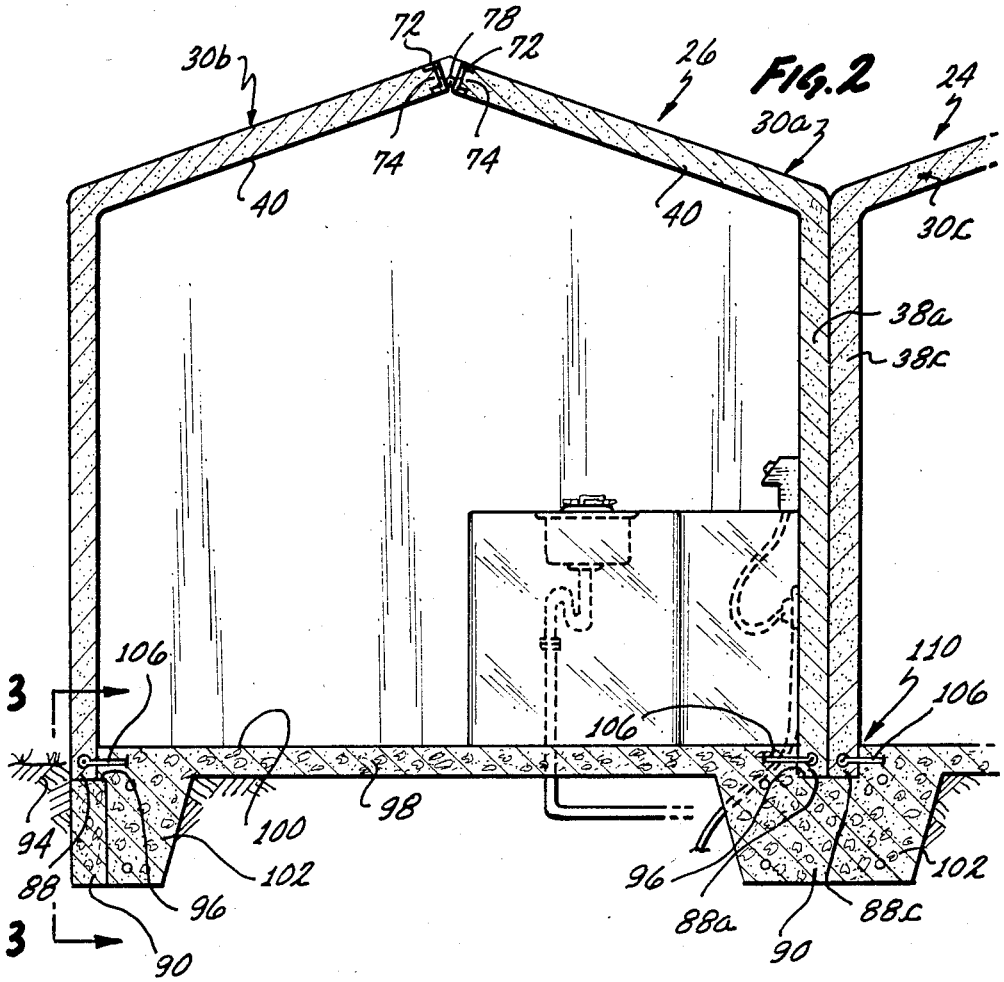
FIG. 2 is a side elevational view in section showing certain construction details thereof.
Figure 5A:
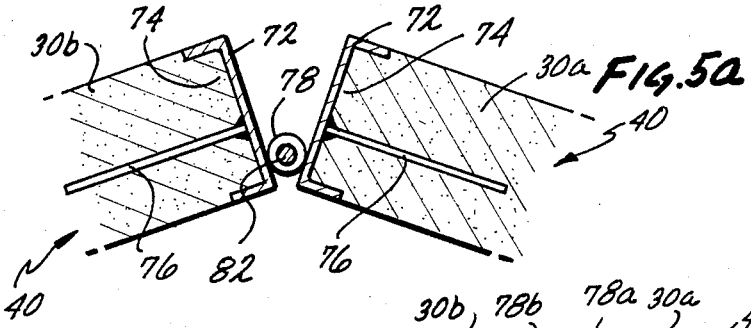
FIG. 5*a* is an end elevational view in section showing the roof joining technique of the invention in detail.

Referring now to FIGS. 2 and 5 the preferred method of attaching the roof portions of any of the modules are described. In FIGS. **5*a* and 5*b* it can be seen that U-shaped plates 72 are attached to the joining edge 74 of the roof portion 40 of the modular unit 30. Each of the U-shaped plates 72 is held to the roof portion 40 via a dowel 76 welded to the plate 72 and entrained into the material of the modular unit 30** during casting as herein after described.

Figure 5B:
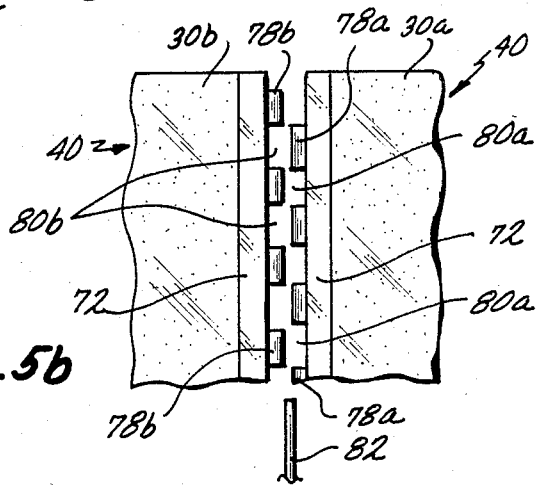
FIG. 5*b* is a top plan view showing this roof joining technique in detail.
Figure 6:
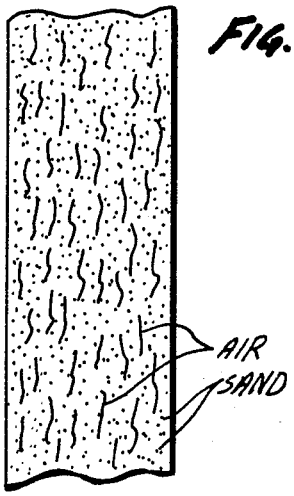
FIG. 6 is a side elevational view of an exploded view of one of the vertical walls as seen in FIG. 2.

A series of tubular units 78 are welded to the U-shaped plates 72 prior to incorporation onto the joining edge 74. The units 78 are spaced along the U-shaped plate 72 such that when two modular units 30 are brought together, as is seen in FIG. 5*b*, a piano type hinge is achieved with the tubular units 78*a* on modular unit 30*a* fitting into the spaces 80*b* between the tubular units 78*b* on modular unit 30*b* and likewise for the tubular units 78*b* fitting into the spaces 80*a* on the modular unit 30*a*. After the tubular units 78 are aligned with one another a metal dowel 82 is inserted through the units 78*a* and 78*b* to form a piano hinge between the modular units 30*a* and 30*b*.

As so connected the modular units 30*a* and 30*b* are capable of pivotable movement with respect to one another. Because of the pivotable movement about the metal dowel 82, the bottom edge of the wall portion 38 of the modular units 30 under the weight of the modular units 30 tend to have an outward or lateral thrust with respect to one another.

Advantage is taken of the outward lateral thrust of the bottom edges of each of the wall portions 38 of the modular unit 30 (and of the other wall portions of the other modular units in a like manner) to tie the two modular units 30 together in a unique manner. Prior to discussing this aspect of this invention, however, formation of an on-site erection of the particular modular units 30 and the other similar modular units will be described.

The particular modular units 30, 44, 52 or 60 and other similar modular units as design considerations dictate are formed as follows. An appropriate form is constructed mimicking the shape of the modular units such as modular unit 30 for instance. The form is located on a suitable support surface such that one of the edges such as the edge identified by the numeral 84 in FIG. 7 is on the support surface with its opposite side edge such as the edge identified by the numeral 86 in FIG. 7 being elevated. The modular unit 30 is then cast in the form as a monolithic unified entry. Thus the roof portion 40 is integrally formed with the wall portion 38. During casting appropriate erection hardward and connecting hardware is incorporated into the modular unit. Normally the structure such as structure 20 utilizing the modular units such as modular units 30 will be erected by a work crew utilizing cranes and the like. Appropriate hardware from suppliers such as that available from Dayton Superior Corporation, Santa Fe Springs, CA, is utilized during the casting procedure to form anchor points for lifting the particular modular units during erection and for tying both the joining edges 74 along the ridge line and the supporting edges 88 alone the bottom of the wall portion such as wall portions 38.

The preferred construction material for the modular units such as units 30, 44, 52 and 60 would be a lightweight gas entrained concrete such as an air entrained concrete of a density of about 110 pounds per cubic foot and suitable compression strength such as the compression strength of 2,000 psi. Suitable reinforcing steel would be utilized within the particular units such as grade 60 rebar.

Once proper curing of the cast module has taken place it is appropriately demolded. It is evident by the shape of the illustrative designs shown in FIGS. 7, 8, 9 and 10 that simple two piece molds can be constructed with no under-cuts and the like present in the molds. The individual modular units can be cast at a central location and then trucked on flat-bed trucks to the erection site of the structures which are being built. Alternately, they could be cast on-site in those instances such as where a large housing development or apartment complex is being constructed.

Figure 3:
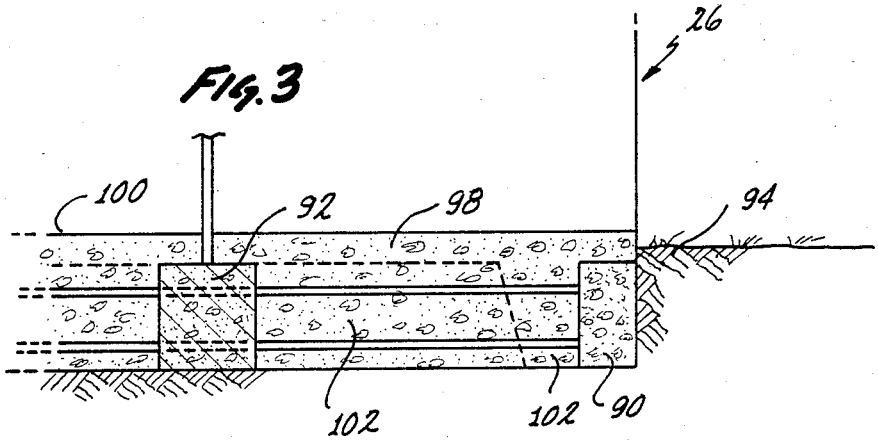
FIG. 3 is an end elevational view in section about the line 3—3 of FIG. 2 showing additional construction details.
Figure 4:
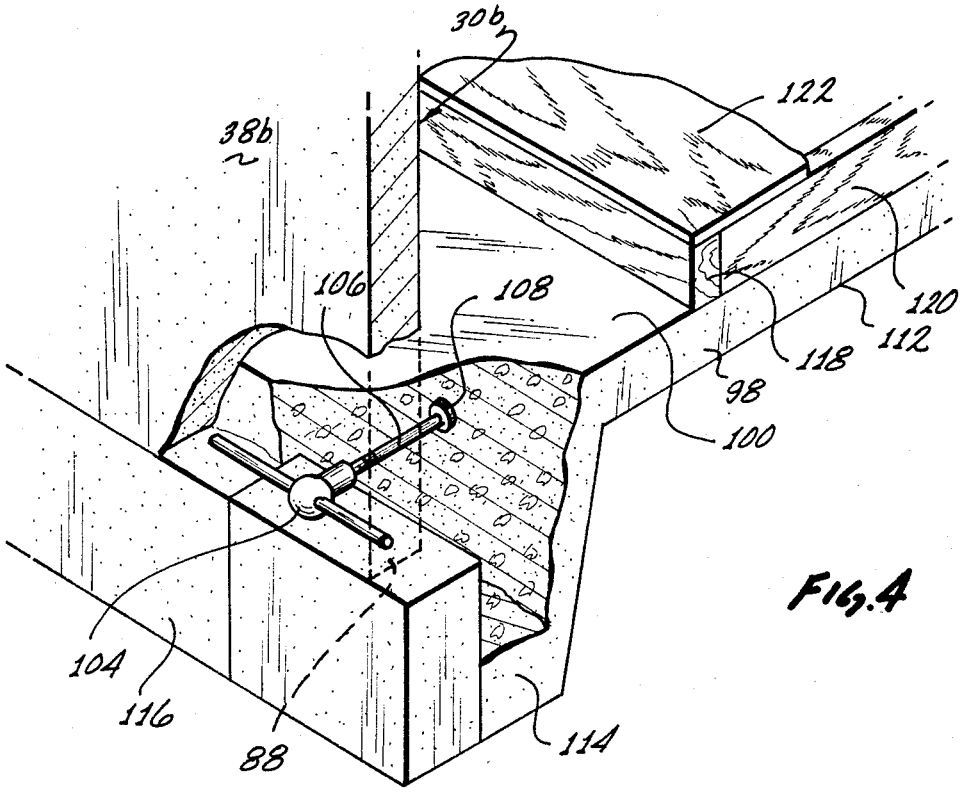
FIG. 4 is an isometric view showing certain construction components in greater detail and illustrating additional components not seen in FIG. 2.

In any event once the particular modular units such as modular unit 30 are formed and are located at the building site assembly of the structure proceeds as follows. Erection pads as can be seen in FIGS. 2, 3 and 4 are utilized to temporarily support the individual modular units during erection of a structure. In FIG. 3 erection pad 90 is utilized at the end of a component 26 with erection pad 92 being utilized where two particular modular units are located longitudinally next to one another. Of course, additional erection pads such as pads 90 and 92 would be used other places within the structure such as structure 20 as is dictated by the number of modular units which are being assembled together.

The erection pads such as erection pad 90 are placed in the surrounding supporting medium such as the ground 94 with their upper or support surface 96 appropriately positioned at the level wherein the support edge 88 of the modular units 30 will be located. For each of the modular units such as modular units 30 two erection pads such as pads 90 and 92 are appropriately placed in order to support the modular unit 30 temporarily during erection of the structure.

Once the erection pads such as pads 90 and 92 are appropriately placed in the ground 94 with their surfaces 96 appropriately positioned and leveled according to the building plan, the modular units 30 are then positioned thereon and temporarily held in place by fugitive bracing until such time as the joining edges 74 on each of the individual modular units attached are together with a metal dowel 82 as previously described. Once the joining edges 74 are appropriately attached bracing of the modular units 30 need only be done with respect to thrust of their supporting edges 88 outwardly.

After the modular units 30*a* and 30*b* as seen in FIG. 2 are appropriately attached together along their joining edges 74, the third structural component, the base 98, in cast in situ. In FIGS. 2 and 3 the base 98 is formed as a continuous floor 100. Near the supporting edge 88 and underneath it in those areas where the erection pads 90 and 92 are not located the base 98 is flared to include a footing 102. The footing 102 entrains the erection pads 90 and 92 therein during pouring of the same such that the erection pads become an integral part of the footing 102 upon curing of the same. As can be seen in the right hand side of FIG. 2 in those areas where an erection pad is not located the footing 102 completely fills the area underneath the wall portion 38 to support the same.

Referring now to FIG. 3 construction details showing how the lateral outward thrust of the support edge 88 of the wall portions 38 is counteracted is illustrated. During casting of the modular unit 30 an appropriate loop insert 104, as supplied by a supplier such as Dayton Superior Corporation previously mentioned, is positioned near the supporting edge 88. Once the modular unit 30 is placed on the erection pad 90 a threaded bolt 106 is threaded into the insert 104. When the base 98 is poured the head of the bolt 108 as well as the remainder of the same which is exposed out of the loop insert 104 is entrained within the base 98 and upon curing of the base 98 an attachment is formed via threaded bolt 106 between the base 98 and the modular unit 30.

Insofar as the threaded bolt 106 is an appropriate metal bolt or the like it is capable of a slight degree of flexture and as such the connection between the lower most part of the wall portion 38 of the modular unit 30 and the base 98 has a degree of flexibility or flexure as so. During a cataclysmic weather event, such as a high wind storm or other equally stressful acts of nature such as earthquakes, the totality of the structure composed of the base 98 and the modular unit 30*a* and 30*b* are capable of some flexure about their attachment points together.

Together the three units 30*a*, 30*b* and 98 form a three hinged arch. The downward thrust of the roof portions 40 of the modular units 30 is transferred to lateral thrust at the bases of the wall portions 38 with this lateral thrust then transferred to the base member 98 by the connecting member bolt 106. Preferredly two such bolts 106 would be utilized to attach each of the individual modular units 30 to the base 98.

On the right hand side of FIG. 2 near the bottom of the figure it can be seen that two wall portions 38*a* and 38*c* of modular units 30*a* and 30*b* are abutted up one against the other. The footing 102 directly underneath the wall portions 38*a* and 38*c* when cured includes a groove 110 into which the individual supporting edges 88*a* and 88*c* of the individual modular units 30*a* and 30*c* are positioned. The formation of the groove 110 serves to tie the two adjacent living components 24 and 26 together against lateral separation of the same. The same type of structure would also be utilized to attach the garage component 22 to the component 24. Further, for the structure 20 the component 28 would be attached to the component 26 utilizing similar inserts such as inserts 104 and threaded bolts 106 to attach these two components to the continuous base 98 which would underlie each of them.

For the construction shown in FIGS. 2 and 3 a monolithic base 98 is utilized as the lateral attaching member of the individual modular units 30, the floor of the structure 20 and the foundation member for the totality of the structure 20. Alternately as seen in FIG. 4 girders such as girder 112 could be utilized to provide the lateral structural integrity for the completed structure. The girder 112 as with the base 98 previously mentioned would be cast or poured in situ after the appropriate unit such as modular unit 30 is positioned on erection pad 90. The girder 112 would be appropriately attached to the modular unit 30*b* utilizing the same threaded bolt 106 attaching to loop insert 104 previously described. As with the base 98 the girder 112 would have a footing area 114 formed as an intrigal part thereof. Additionally, the footing 114 would be continuous with the remainder of a footing area 116 directly underlying the wall portion 38*b*.

For each pair of modular units such as modular units 30 two girders such as girder 112 would be utilized with the girders appropriately attaching to the particular modular units near where the erection pads 90 and 92 are positioned. It is evident that where the end walls of two modular units such as units 30*b* and 30*e* in FIG. 7 meet a single girder could be utilized in this area serving as the lateral support member for both the modular units 30*a* and 30*b* and the modular units 30*d* and 30*e* on either side of the central girder.

With the use of the girder systems as the lateral support system an appropriate conventional floor could be constructed utilizing two by fours and the like 118 and 120 overlayed with an appropriate flooring such as flooring 122.

Normally the base 98 or the girders 112 would be formed of an appropriate concrete aggragate incorporating suitable structural steel as necessary. Alternately, however, a light-weight air or gas entrained aggragate such as is preferredly used for the modular units themselves could be utilized for the base 98 or the girders 112. Portions of the girders 112 could be factory formed with the tying together of the left and right modular units then completed by in situ casting of the remainder of the girder at the construction site.

The gap remaining over the tubular members 78 after joining the appropriate roof portions 40 or other roof portions together would be filled with a suitable water repellent material. Likewise, the spaces between individual longitudinally placed modular unit such as units 30*b* and 30*e* would be also be sealed. The exterior of the structure such as the residential structure 20 formed by the modular units could be suitably coated with a decorative finish such as a blown on sand finish, skip-troweled finish or other suitable conventional finishes. Further, since the preferred structure material for the modular units of this invention is a gas entrained aggragate mixture, such as air entrained concrete, insulative properties are built into the structure.

For the formation of appropriate blank areas in the individual modular units such as modular unit 30 wherein the placement of doors and windows is desired appropriate plugs representing these blank areas can be included in the molds during casting of the particular modular unit. Alternately specific molds shaped to include such openings could be utilized.

I claim:

1. A structural building module which comprises:

(a) a first integrally cast upright structural member having a first single substantially vertical exterior wall portion and a first roof portion angularly disposed with respect to said first wall portion at an internal angle of greater than 90 degrees, said first wall portion having a support edge along the bottom portion thereof, said first roof portion having a joining edge therealong;

(b) a second integrally cast upright structural member having a second single substantially vertical exterior wall portion and a second roof portion, said second wall portion having a support edge along the bottom portion thereof, said second roof portion having a joining edge therealong;

(c) a first structural member support means and a second structural member support means, said first and said second support means locatable in the supporting medium on which said structural building module will rest, each of said first and second support means having a portion thereof located near the surface level of said medium, each of said support means for supporting one of said structural members in an upright position on said portion of said support means located near surface level by contact of said structural member support edges on said portion of said support means located near surface level;

means for effectuating an interdependent compression of said first and second roof portions of said joining edges on said first and second roof portions when said joining edges are alignably disposed in face-to-face edgewise relationship to each other and by preventing lateral movement of the support edges of the first and second wall portions of said first and second structural members;

said first and second support means spaced apart from each other in said support medium a distance essentially corresponding to the finished width of said structural building module whereby when said first and second upright structural members are located upright on and supported by said first and second support means said first and said second roof portions extend towards each other from said respective first and second wall portions to located said joining edges adjacent to each other in a position joinable by said joining means and together said first and second roof portions form the roof of said structural module;

an in situ formed structural base means, said structural base means formed by casting in situ after said first and said second upright structural members are located on and supported by said first and second support means, as formed said structural base means operatively connecting to said support edges on both said first and said second upright structural members and extending essentially horizontally between said support edges of said first and said second upright structural members;

said structural base means operatively connecting to said support edges and said joining means joining said joining edges serving to hold said first and said second structural members connected to one another in an upright position with said first and said second wall portions being essentially vertical and said first and said second roof portions forming said roof between said respective wall portions.

2. The module of claim 1 wherein:

said structural base means further includes footing means for permanently supporting said structural building module on said support medium, said footing means formed in situ casting in combination with said in situ casting of said structure base means, said footing mean located below said walls portions of said first and said second upright structural members.

3. The module of claim 2 wherein:

said structural base means forms at least a portion of a floor of said module.

4. The module of claim 3 including:

attaching means for joining said structural base means to each of said first and said second structural members proximal to their said support edges.

5. The module of claim 4 wherein:

said attaching means connecting to said first and second structural member prior to said in situ formation on said structural base means.

6. The module of claim 5 wherein:

said attaching means joining to said structure base means by entraining a portion of said attaching means into said structural base means.

7. The module of claim 6 wherein:

said first and said second support means are entrained into said footing means when said footing means is cast in situ.

8. The module of claim 7 wherein:

said first support means includes a first and a second foundation member;

said second support means includes a third and a fourth foundation means;

each of said first, said second, said third and said fourth foundation members having a portion thereof located near said surface level;

said first and said second foundation members located with respect to each other and to said first wall portion such that when said first structural member is supported on said first support means said first and said second foundation members are spaced apart from one another along said support edge of said first structural member;

said third and said fourth foundation members located with respect to each other and to said second wall portion such that when said second structural member is supported on said second support means said third and said fourth foundation members are spaced apart from one another along said support edge of said second structural member.

9. The module of claim 8 wherein:

said first, said second, said third and said fourth foundation members are entrained into said footing means when said footing means is cast in situ.

10. The module of claim 9 wherein:

said joining means comprises a hinge means, a portion of said hinge means located on said joining edge on said first structural member and a portion of said hinge means located on said joining edge on said second structural member, said portions of said hinge means located on said first and said second structural members pivotally connected together so as to pivotally connect said first and said second roof portions together.

11. The module of claim 10 wherein:

said attaching means includes a first connecting member and a second connecting member, said first connecting member pivotally connecting to said first wall portion near said support edge of said first wall portion, said second connecting member pivotally connecting to said second wall portion near said support edge of said second wall portion, a portion of both of said first and said second connecting members entrained into said structural base means when said structural base means is cast in situ so as to pivotally connect said first and said second structural members to said structural.

12. The module of claim 11 wherein:

each of said first and said structural members are formed from a gas entrained aggregate.

13. The module of claim 12 wherein:

said aggregate is a concrete aggregate.

14. The module of claim 13 wherein:

said hinge means comprises a piano hinge, said piano hinge extending along said joining edges of both said first and said second roof portions.

15. A process of constructing a modular building which comprises:

casting a first and a second structural member from a gas entrained aggregate, said first and said second structural members each having a wall portion and a roof portion, each of said roof portions having a joining edge, each of said wall portions having a support edge, said joining edge and said support edge on each of said respective first and said second structural members located distal to each other on said respective first and said second structural members;

locating a portion of a joining means on said joining edge on said first structural member and locating a further portion of said joining means on said joining edge on said second structural member;

locating a first support means in the supporting medium on which said modular building will rest and locating a second support means in said supporting medium at a distance spaced apart from said first support means equal to essentially the width of said modular building, said first and said second support means each located in said supporting medium so as to position a portion of each of said support means near the surface level of said supporting medium;

locating said first structural member on said first support means and said second structural member on said second support means such that each of said first and said second wall portions are essentially vertical and said joining edges on each of said first and said second structural members are located adjacent to one another;

joining said first and said second portions of said joining means to pivotally connect said first and said second structural members together about their respective joining edges;

casting a structural base means between said support edge on said first structural member and said support edge on saidl second structural member so as to operatively connect said support edges on both said first and said second structural member to said structural base.

16. The process of claim 15 further including: attaching said structural base means to each of said first and said structural members by extending an attaching means from each of said first and said second structural members near their support edges and in entraining said attaching means into said structural base means upon casting said structural base means.

* * * * *